US005582966A

United States Patent [19]

Nakamura et al.

[11] Patent Number: 5,582,966

[45] Date of Patent: Dec. 10, 1996

[54] METHOD FOR PRODUCING A SILVER HALIDE PHOTOGRAPHIC LIGHT-SENSITIVE MATERIAL

[75] Inventors: Hiroshi Nakamura; Toshiharu Nagashima; Yasuhiro Wakasugi, all of Tokyo, Japan

[73] Assignee: Konica Corporation, Japan

[21] Appl. No.: 417,035

[22] Filed: Apr. 5, 1995

[30] Foreign Application Priority Data

Apr. 27, 1994 [JP] Japan ..... 6-090044

[51] Int. Cl.[6] ..... G03C 1/32; G03C 1/76

[52] U.S. Cl. ..... 430/569; 430/567; 430/600; 430/613; 430/614; 430/598; 430/950

[58] Field of Search ..... 430/567, 569, 430/600, 613, 614, 598, 950

[56] References Cited

U.S. PATENT DOCUMENTS

| | | | |
|---|---|---|---|
| 5,061,595 | 10/1991 | Gingello et al. | 430/523 |
| 5,175,073 | 12/1992 | Gingello et al. | 430/523 |
| 5,258,275 | 11/1993 | Arai et al. | 430/523 |

*Primary Examiner*—Mark F. Huff
*Attorney, Agent, or Firm*—Jordan B. Bierman; Bierman and Muserlian

[57] ABSTRACT

A method for producing a silver halide photographic light-sensitive material is disclosed. The silver halide photographic light-sensitive material comprises a support having thereon photographic layers including a silver halide emulsion layer, a first hydrophilic colloid layer and an outermost second hydrophilic colloid layer in this order from the support. The light-sensitive material is produced by a method comprising steps of forming the photographic layer by coating a silver halide emulsion coating solution comprising silver halide grains, gelatin and water to form said silver halide emulsion layer;

a first hydrophilic colloid solution comprising gelatin and water to form said first hydrophilic colloid layer; and a second hydrophilic colloid solution comprising gelatin, particles of matting agent having a size of not less than 4 μm in an amount of 4 mg/m$^2$ to 50 mg/m$^2$ and water to form said outermost second hydrophilic colloid layer; on a support, and drying the coated photographic layers under a condition satisfying the following requirements:

(1) the surface temperature of the coated photographic layer is maintained at a temperature within the range of 4° C. to 19° C. during the period in which the ratio of water to gelatin in the photographic layer is decreased 800% to 200%; and (2) the time to be spent for decreasing the ratio of water to gelatin in the photographic layer from 800% to 200% is within the range of from 35 seconds to 300 seconds.

8 Claims, 1 Drawing Sheet

METHOD FOR PRODUCING A SILVER HALIDE PHOTOGRAPHIC LIGHT-SENSITIVE MATERIAL

FIELD OF THE INVENTION

The present invention relates to a method for producing a silver halide photographic light-sensitive material for graphic arts use (hereinafter called merely a light-sensitive material), and more particularly to a method for producing a light-sensitive material which is excellent in the touchableness in vacuum contacting and which is free from pinhole trouble.

BACKGROUND OF THE INVENTION

In the graphic arts field, there has been a strong demand for shortening the vacuumizing time of a contact printer for the light-sensitive material exposure; in other words, for the development of a light-sensitive material that can be exposed with no problem even within 10 minutes of vacuumizing time of the vacuum contact printer in the contact printing process.

To solve the above problem, Japanese Patent Publication Open to Public Inspection (hereinafter abbreviated to JP O.P.I.) Nos. 91738/1991 and 127049/1991 propose techniques to improve the light-sensitive material's touchableness in vacuum contacting by the combination of having the light-sensitive material substantially contain a relatively large particle size matting agent and drying it under slow drying conditions.

However, the recent movement to shorten working hours and time for delivery results in a demand for shortening the processing time. The shortening of the processing time largely deteriorates the dryness of the processed light-sensitive material. To solve this problem, the amount of gelatin as the binder was reduced, and to shorten the vacuumizing time, a large particle size matting agent was used. However, reducing the amount of gelatin causes the coated layer to be thin, and besides, the use of a large particle size matting agent caused the agent to be buried in the emulsion layer, and as a result it clearly increased the number of the pinholes caused thereby. The more the silver saving is exerted for making the most of resources, the more badly the number of pinholes caused by a matting agent increases.

To get rid of the pinhole trouble, an attempt was made to divide the layer to contain a matting agent provided upon the emulsion layer, normally protective layer, into two sublayers, of which the upper sublayer had a matting agent incorporated therein to thereby restrain the matting agent from being buried in the emulsion layer, and further a slow drying condition was used in combination, whereby the improvement was to have been achieved, but the attempt was in vain, particularly it has been found that when the coating silver weight is not more than 3.0 g/m$^2$, little improving effect can be obtained. Thus, there is urgently needed a technique for improving the light-sensitive material to be free from the pinhole trouble without deteriorating its vacuum touchableness even in the case where gelatin reduction is made.

SUMMARY OF THE INVENTION

It is an object of the invention to provide a method for producing a light-sensitive material which is improved to be free from pinhole trouble caused by matting agent as well as to be adaptable to a shortened vacuumizing time even when having its gelatin reduced for the purpose of its dryness improvement due to shortening the developing process therefor.

It is another object of the invention to provide a method for producing a light-sensitive material improved to be free from pinhole trouble caused by matting agent as well as to be adaptable to a shortened vacuumizing time of a printer even when having its silver coating weight reduced.

The above objects of the invention are accomplished by the following:

The above object of the-invention are accomplished by a method for producing a silver halide photographic light-sensitive material, which comprises a support and photographic layers including a silver halide emulsion layer, a first hydrophilic colloid layer and an outermost second hydrophilic colloid layer provided on the support in this order from the support, comprising steps of forming the photographic layers by coating a silver halide emulsion coating liquid comprising silver halide grains, gelatin and water to form the silver halide emulsion layer; a first hydrophilic colloid coating liquid comprising gelatin and water to form the first hydrophilic colloid layer; and a second hydrophilic colloid coating liquid comprising gelatin, particles of matting agent having a size of not more than 4 μm in an amount of 4 mg/m$^2$ to 50 mg/m$^2$ and water to form the outermost second hydrophilic colloid layer; on a support, and drying the photographic layers under a condition satisfying the following requirements:

(1) the temperature of the outermost surface of the photographic layers is maintained at a temperature within the range of 4° C. to 19° C. during the period in which the ratio of water to gelatin in the photographic layers is decreased from 800% to 200%; and (2) the time to be spent for decreasing the ratio of water to gelatin in the coated layers from 800% to 200% is within the range of from 35 seconds to 300 seconds.

In an embodiment of the invention, it is preferable that the method further satisfy the following conditions:

1) The total amount of gelatin on the above silver halide emulsion layer-coated side is 0.5 g/m$^2$ to 2.5 g/m$^2$.

2) the gelatin concentration of the hydrophilic colloid layer adjacently underneath said topmost hydrophilic colloid layer is higher than that of said topmost layer.

3) The silver coating weight is 1.0 g/m$^2$ to 3.0 g/m$^2$.

4) The silver halide photographic light-sensitive material is subjected to a processing whose overall processing time from the development through drying is within 45 seconds.

The surface roughness of the above light-sensitive material is preferably not less than 25 mmHg when it is measured by a measuring instrument SMOOSTER SM-6.

DETAILED DESCRIPTION OF THE INVENTION

Figure 1:
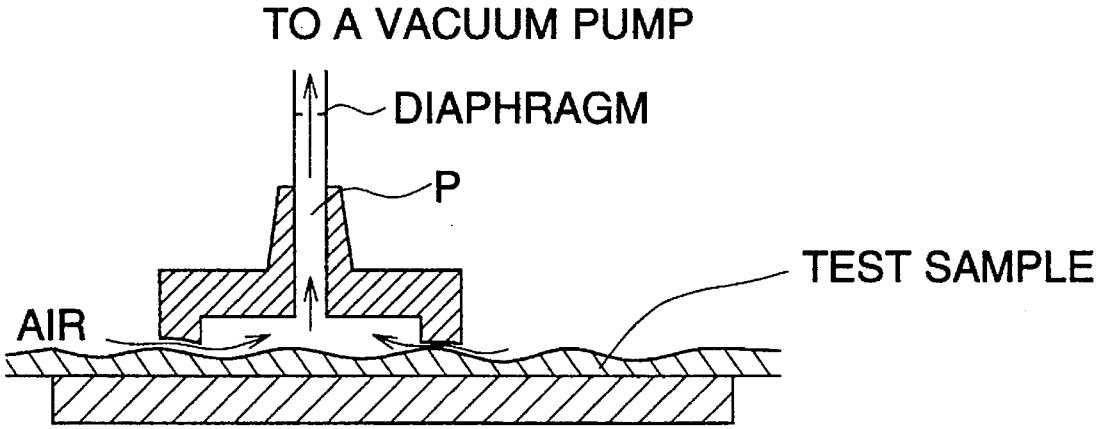
FIG. 1 is a schematic drawing of a measuring instrument for surface roughness.

In a light-sensitive material produced by the method of the invention, at least one of the hydrophilic colloid layers constituting the light-sensitive material, preferably the topmost layer, contains a regular- and/or irregular-form matting agent. In the invention, the topmost layer on the silver halide emulsion-containing side of the support contains a regular- and/or irregular-form matting agent having a particle size of not less than 4 μm, preferably 4 μm to 20 μm, in an amount of 4 mg/m$^2$ to 50 mg/m$^2$, and more preferably also contains in combination a regular and/or irregular matting agent having a particle size of less than 4 μm.

In the invention, each of the emulsion layer and the first and second layers contains gelatin as a binder. These layers may further contain other hydrophilic colloid materials; for example, various synthetic hydrophilic polymer materials including gelatin derivatives; graft polymers of gelatin with other high polymer materials; proteins such as albumin and casein; cellulose derivatives such as hydroxyethyl cellulose, carboxymethyl cellulose, cellulose sulfates; sugar derivatives such as sodium alginate, starch derivatives; and homo- or copolymers such as polyvinyl alcohol, polyvinyl alcohol-partial acetal, poly-N-vinylpyrolidone, polyacrylic acid, polymethacrylic acid, polyacrylamide, polyvinylimidazole, polyvinylpyrazole, and the like.

As the gelatin there may be used lime-treated gelatin, acid-treated gelatin, and hydrolyzed or hydrolased product of gelatin.

The component layers of the silver halide photographic light-sensitive material of the invention may contain a dispersion of synthetic polymers insoluble or less-soluble in water for the purpose of dimensional stability improvement. For this purpose there may be used alone or in combination an alkyl (meth)acrylate, alkoxyacryl (meth)acrylate, glycidyl (meth)acrylate, (meth)acrylamide; vinyl esters such as vinyl acetate; acrylonitrile, olefin, and styrene, or there may be used a polymer comprised in combination of monomers such as these acrylic acids, methacrylic acids, α,β-unsaturated dicarboxylic acid, hydroxyalkyl (meth)acrylate, sulfoalkyl (meth)acrylate, styrenesulfonic acid, and the like.

As the matting agent for the invention there may be used any one of known matting agents, including the silica described in Swiss Patent No. 330,158; the glass powder described in French Patent No. 1,296,995; the inorganic particles such as of alkaline earth metals, zinc carbonate, etc.; the starch described in U.S. Pat. No. 2,322,037; the starch derivatives described in Belgian Patent No. 625,451 and British Patent No. 981,198; the polyvinyl alcohol described in Japanese Patent Examined Publication (hereinafter abbreviated to JP E.P.) No. 3643/1969; the polystyrene or polymethylmethacrylate described in Swiss Patent No. 330,158; the polyacrylonitrile described in U.S. Patent No. 3,079,257; and organic particles such as the polycarbonate described in U.S. Pat. No. 3,022,169.

These matting agents may be used alone or in combination. Regarding the form of the matting agent particle, the regular form matting agent takes preferably a spherical form, but may take other forms such as a tabular or cubic form. The size of the matting agent particle is expressed in terms of the diameter of a sphere equivalent in the volume to the particle. The term 'matting agent's particle size' herein means this sphere-equivalent diameter.

In order to have the matting agent accomplish its function, the matting agent is preferably partially exposed on the surface of the light-sensitive material. The exposed matting agent on the surface may be either part of or the whole of the matting agent added. The addition of the matting agent may be made in the manner of coating a coating liquid prepared by in advance dispersing the matting agent thereinto. Where plural different matting agents are to be added, both the above methods may be used in combination.

In order to shorten the processing time, it is preferable to reduce the amount of gelatin for drying in a short time. The reduction in the amount of gelatin, however, causes the matting agent to be buried in to thereby increase the number of pinholes as has been mentioned.

In the invention, it is important that the gelatin concentration of the layer adjacent to the topmost layer of the light-sensitive material is higher than the gelatin concentration of the topmost layer. Reducing the total amount of gelatin in the photographic layers to be coated on the silver halide emulsion side to 0.5 g/m$^2$ to 2.5 g/m$^2$ is effective in getting rid of the pinhole trouble. More preferably, when the amount of gelatin is reduced to 0.5 g/m$^2$ to 2.0 g/m$^2$, larger improving effect can be obtained.

In the invention, the gelatin concentration means the percentage of the amount of gelatin accounting for of the coating liquid, and expressed in a gelatin/water ratio.

$$\text{Gelatin concentration (\%)} = \frac{\text{gelatin (weight)}}{\text{water (volume)}} \times 100$$

The gelatin concentration of the coating liquid is normally 1.0 to 8.0%.

In the light-sensitive material's coating/drying process, a coating liquid of a composition comprising a hydrophilic colloid like gelatin as the binder is coated on a support, then generally cooled to be set in a low-temperature air at a drybulb temperature of −10° to −15° C., and then the temperature is raised to evaporate the moisture from the coated layer. The gelatin/water content ratio by weight immediately after the coating is normally around 2000%. As a result of our investigation, it has been found that in the drying process, the drying time and the coated surface temperature during the period when the water/gelatin ratio by weight reduces from 800% to 200% bring a surprising effect to the surface condition and pinhole formation of a light sensitive material.

As for the coating and drying of the light-sensitive material, a coating liquid of a composition comprised mainly of gelatin as a binder is coated on a support, and thereupon the coated layer is cooled to be set in a low-temperature air at a dry-bulb temperature of from −5° to −15° C., but in this instance, it has been found that the improvement can be attained by using the following combination: In order to lessen the submergence of the matting agent, at least two hydrophilic colloid layers are provided on the silver halide emulsion layer; the lower hydrophilic colloid layer adjacent to the topmost layer has a gelatin concentration of not less than 3.0%, which is 0.5% higher, preferably 1.0% higher than the gelatin concentration of the matting agent-containing topmost hydrophilic colloid layer; and the coated surface temperature on the silver halide emulsion layer-containing side during the time when its water/binder ratio by weight reduces from 800% to 200% is not more than 19° C., and the drying time required for the ratio to reduce from 800% to 200% is not less than 35 seconds. The above improvement effect is what has been unexpected from each individual effect. The smaller the amount of gelatin, the larger the improvement effect.

In the invention, the coated surface average temperature when the water/gelatin ratio by weight is in the range of 800% to 200% is expressed by the wet-bulb temperature of the drying air, preferably 4° C. to 19° C., more preferably 4° C. to 17° C. The drying time required for the ratio to reduce from 800% to 200% is preferably 35 seconds to 300 seconds, more preferably 40 seconds to 300 seconds.

In the invention, there may be provided an antistatic layer as described in JP O.P.I. No. 91739/1991.

In this instance, the surface resistivity on the antistatic layer-provided side is preferably not more than $1.0\times10_{11}\Omega$, and more preferably $8\times10^{11}\Omega$.

The above antistatic layer is preferably an antistatic layer comprising water-soluble conductive polymer particles, hydrophobic polymer particles and a reaction product of a hardening agent or an antistatic layer comprising a powdery metal oxide.

The above water-soluble conductive polymer is a polymer having at least one conductive group selected from the class consisting of a sulfo group, a sulfate group, a quaternary ammonium salt group, a tertiary ammonium salt group, a carboxyl group and a polyethyleneoxido group. The preferred among these groups are the sulfo group, sulfate group and quaternary ammonium salt group. The conductive group is required to be in an amount of not less than 5% by weight per molecule of the water-soluble conductive polymer. The water-soluble conductive polymer can contain a carboxyl group, a hydroxyl group, an amino group, an epoxy group, an aziridine group, an active methylene group, a sulfinic acid group, an aldehyde group, a vinylsulfone group, etc. The preferred among them are the carboxyl, hydroxyl, amino, epoxy, aziridine and aldehyde groups. Any of these groups need to be contained in an amount of not less than 5% by weight per molecule of the polymer. The average molecular weight of the water-soluble conductive polymer is 3000 to 100000, preferably 3500 to 50000.

Suitably usable as the above metal oxide are tin oxide, indium oxide, antimony oxide, zinc oxide, and those produced by doping these metalic oxides with metallic phosphorus or metallic indium. The average particle size of these metallic oxides is preferably 1 μm to 0.01 μm.

The silver halide emulsion for the light-sensitive material of the invention may be of any arbitrary silver halide usable for ordinary silver halide emulsions, such as silver bromide, silver iodobromide, silver chloride, silver chlorobromide, silver chloroiodobromide. The preferred among these silver halides is silver chlorobromide containing 50 mol % or above silver chloride. The silver halide grain may be produced according to any one of the acidic method, neutral method and ammoniacal method. The silver halide emulsion used in the invention may comprise grains of a single composition or plural different compositions contained in a single layer or separately contained in plural layers.

The configuration of the silver halide crystal grain according to the invention is arbitrary; a suitable example is a cube having {100} planes as its crystal faces. There may also be used different other crystal grains such as octahedral, tetradecahedral or dodecahedral crystal grains prepared according to appropriate methods as described in U.S. Pat. Nos. 4,183,756 and 4,225,666; JP O.P.I. No. 26589/1980; and JP E.P. No. 42737/1980; and J. Photgr. Sci., 21, 39 (1973). Further, twin planes-having crystal grains may also be used.

The silver halide grain in the invention may be a grain of a single form or a composite form comprising various different crystal forms.

The silver halide grains used in the invention are allowed to be of any grain diameter distribution; they may be of either a broad grain diameter distribution called polydisperse emulsions or a narrow grain diameter distribution called monodisperse emulsions; they may be used alone of in combination. Both the polydisperse emulsion and the monodisperse emulsion may be used in a mixture.

The silver halide emulsion used in the invention may be a mixture of two or more different silver halide emulsions separately prepared.

In the invention, the monodisperse emulsion is preferred. The monodisperse silver halide grains in the monodisperse silver halide emulsion are such that the weight of the silver halide contained within the average grain diameter $\bar{r}$ $^{+}$20% range accounts for preferably not less than 60%, more preferably not less than 70%, and most preferably not less than 80% of the whole silver halide grains.

The above average grain diameter $\bar{r}$ is defined as the grain diameter ri in the case where $ni\times ri^3$, the product of the frequency ni of grains having a grain diameter ri and $ri^3$, becomes maximum (rounded off to three decimal places).

The grain diameter herein, in the case of a spherical silver halide grain, is its diameter, and in the case of a nonspherical grain, is the diameter of a circular image equivalent in the area to its projection image.

The grain diameter can be obtained by actually measuring the diameter of a 10,000-fold to 50,000-fold electron-photomicrographically enlarged grain image print or the area of a projected grain image enlarged likewise, the number of grains to be measured shall be 1,000 at random.

The most preferred highly monodisperse emulsion of the invention is one having a grain diameter distribution broadness of preferably not more than 20%, more preferably not more than 15%, said distribution broadness being defined by:

$$\frac{\text{Grain diameters standard deviation}}{\text{Average grain diameter}}\times 100 = \text{distribution broadness}$$

For obtaining the monodisperse emulsion, reference can be made to JP O.P.I. Nos. 48521/1979, 49938/1983 and 122935/1985.

The light-sensitive silver halide emulsion may be used as it is (primitive emulsion) without being chemically sensitized, but in most cases, it is chemically sensitized. For the chemical sensitization, there are a sulfur sensitization method which uses a compound containing sulfur that is capable of reacting with silver ions or uses an active gelatin; a reduction sensitization method which uses a reductive material; and a noble metal sensitization method which uses a gold compound or other noble metal compound; these sensitization methods may be used in combination. As the sulfur sensitizer there may be used thiosulfates, thioureas, thiazoles, rhodanines and other compounds. Examples of the reduction sensitizer include stannous salts, amines, hydrazine derivatives, formamidinesulfinic acid, silane compounds, and the like. Examples of the noble metal sensitizer include gold complex salts and complex salts of the metals belonging to Group VIII of the periodic table, such as platinum, iridium, palladium, etc.

Although conditions of pH, pAg and temperature at the time of the chemical sensitization are not particularly restricted, pH value is preferably 4 to 9, more preferably 5 to 8; pAg value is preferably 5 to 11, more preferably 8 to 10; and temperature is preferably 40° to 90° C., and more preferably 45° to 75° C.

As the light-sensitive emulsion, the above emulsions may be used alone or in a mixture of two or more kinds thereof.

In practicing the invention, after completion of the above chemical sensitization, there may be added to the sensitized emulsion 4-hydroxy-6-methyl-1,3,3a,7-tetrazaindene, 5-mercaptol-phenyltetrazole, 2-mercaptobenzothiazole, or various other stabilizers.

Further, if necessary, there may be added a silver halide solvent such as thioether, and a crystal habit control agent such as a mercapto group-containing compound or a sensitizing dye.

The silver halide grain used in the emulsion of the invention may, in the course of forming and/or growing the grain, have metallic ions added thereto by using a cadmium salt, a zinc salt, a lead salt, a thalium salt, an iridium salt or complex salt, a rhodium salt or complex salt, or an iron salt or complex salt, thereby having metallic ions contained inside the grain and/or on the grain surface.

The emulsion of the invention, after completion of growing its silver halide grains, may have its useless water-soluble salts either removed therefrom or remain contained therein. In the case of removing the salts, the removal can be carried out according to the relevant method described in Research Disclosure 17643.

In the silver halide photographic light-sensitive material according to the invention, its photographic emulsion may be spectrally sensitized to a relatively long-wavelength blue light, a green light and a red or infrared light. The dyes used for spectral sensitization include cyanine dyes, merocyanine dyes, complex cyanine dyes, complex merocyanine dyes, holopolar-cyanine dyes, hemicyanine dyes, styryl dyes and hemioxonol dyes.

The sensitizing dye in the invention is used in the same concentration as used for ordinary negative-type silver halide emulsions. It is advantageous to use the sensitizing dye particularly in such a dye concentration range as substantially not deteriorate the silver halide emulsion's intrinsic sensitivity; the sensitizing dye is used in an amount of preferably about $1.0\times10^{-5}$ to $5\times10^{-4}$ mol, more preferably about $4\times10^{-5}$ to $2\times10^{-4}$ mol per mol of silver halide.

The sensitizing dye of the invention may be used alone or in combination of two or more kinds thereof.

The surface roughness value used in the invention is a value obtained by measurement with an instrument Smooster SM-6B, manufactured by Toei Denshi Kogyo K.K.

The surface roughness can be measured by the following method.

In this specification, the surface roughness is defined as a value of suction pressure represented by mmHg measured under a constant condition with respect to a unexposed and not processed photographic material (so-called a raw film) sample. The surface roughness is evaluated with the aid of SMOOSTER, manufactured by Toei Denshi Kogyo K.K.. Thus, utilizing a vacuum type air micrometer, a flow rate of air variable depending upon the roughness of the surface is measured as a change in pressure. The surface roughness is defined as a pressure value expressed in mmHg. The larger the value is, the greater the surface roughness. When measuring the surface roughness, the sample to be tested is placed beneath a head shown in FIG. 1. When a vacuum pump sucks out air inside a tube through a diaphragm having a prescribed aperture area, the pressure inside the tube P (mmHg) is read off.

It is preferable for the light-sensitive material of the invention to contain at least one of tetrazolium compounds or at least one of hydrazine compounds for the purpose of its contrast increase necessary for graphic arts use.

As the tetrazolium compound for the invention there may be used a compound represented by the following Formula I.

Formula I

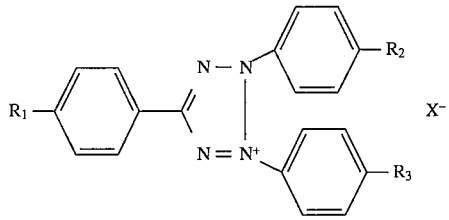

In the above Formula I, $R_1$, $R_2$ and $R_3$ each represent an alkyl group such as methyl, ethyl, cyclopropyl, propyl, isopropyl, cyclobutyl, butyl, isobutyl, pentyl or cyclohexyl; an amino group; an acylamino group such as acetylamino; a hydroxyl group; an alkoxy group such as methoxy ethoxy, propoxy, butoxy or pentoxy; an acyloxy group such as acetyloxy; a halogen atom such as fluorine, chlorine or bromine; a carbamoyl group; an acylthio group such as acetylthio; an alkoxycarbonyl group such as ethoxycarbonyl; a carboxyl group; an acyl group such as acetyl; a cyano group, a nitro group, a mercapto group, a sulfoxy group, or an aminosulfoxy group.

$X^-$ is an anion which includes a halide ion such as a chloride ion, a bromide ion, an iodide ion; an inorganic acid group such as of nitric acid, sulfuric acid or perchloric acid; an organic acid group such as of sulfonic acid or carboxylic acid; an anionic activator including a lower alkylbenzenesulfonic acid anion such as p-toluenesulfonic acid anion, a higher alkylbenzenesulfonic acid ion such as p-dodecylbenzenesulfonic acid anion, a higher alkylsulfate anion such as laurylsulfate anion, a boric acid anion such as tetraphenylboron, a dialkylsulfosuccinate anion such as di-2-ethylhexylsulfosuccinate anion, a polyether-alcohol-sulfate anion such as cetylpolyethenoxysulfate anion, a higher fatty acid anion such as stearic anion, and an acid group-containing polymer such as polyacrylic acid anion.

Examples of the compound represented by Formula I used in the invention are given in Table T, but the compounds of the invention are not limited thereto.

TABLE T

| compound No. | $R_1$ | $R_2$ | $R_3$ | $X^{\ominus}$ |
|---|---|---|---|---|
| I-1 | H | H | H | $Cl^{\ominus}$ |
| I-2 | H | p-$CH_3$ | p-$CH_3$ | $Cl^{\ominus}$ |
| I-3 | H | m-$CH_3$ | m-$CH_3$ | $Cl^{\ominus}$ |
| I-4 | H | o-$CH_3$ | o-$CH_3$ | $Cl^{\ominus}$ |
| I-5 | p-$CH_3$ | p-$CH_3$ | p-$CH_3$ | $Cl^{\ominus}$ |
| I-6 | H | p-$OCH_3$ | p-$OCH_3$ | $Cl^{\ominus}$ |
| I-7 | H | m-$OCH_3$ | m-$OCH_3$ | $Cl^{\ominus}$ |
| I-8 | H | o-$OCH_3$ | o-$OCH_3$ | $Cl^{\ominus}$ |
| I-9 | p-$OCH_3$ | p-$OCH_3$ | p-$OCH_3$ | $Cl^{\ominus}$ |

TABLE T-continued

| compound No. | $R_1$ | $R_2$ | $R_3$ | $X^{\ominus}$ |
|---|---|---|---|---|
| I-10 | H | p-$C_2H_5$ | p-$C_2H_5$ | $Cl^{\ominus}$ |
| I-11 | H | m-$C_2H_5$ | m-$C_2H_5$ | $Cl^{\ominus}$ |
| I-12 | H | p-$C_3H_7$ | p-$C_3H_7$ | $Cl^{\ominus}$ |
| I-13 | H | p-$OC_2H_5$ | p-$OC_2H_5$ | $Cl^{\ominus}$ |
| I-14 | H | p-$OCH_3$ | p-$OCH_3$ | $Cl^{\ominus}$ |
| I-15 | H | p-$OCH_3$ | p-$OC_2H_5$ | $Cl^{\ominus}$ |
| I-16 | H | p-$OC_5H_{11}$ | p-$OCH_3$ | $Cl^{\ominus}$ |
| I-17 | H | p-$OC_8H_{17}$-n | p-$OC_8H_{17}$-n | $Cl^{\ominus}$ |
| I-18 | H | p-$C_{12}H_{25}$-n | p-$C_{12}H_{25}$-n | $Cl^{\ominus}$ |
| I-19 | H | p-$N(CH_3)_2$ | p-$N(CH_3)_2$ | $Cl^{\ominus}$ |
| I-20 | H | p-$NH_2$ | p-$NH_2$ | $Cl^{\ominus}$ |
| I-21 | H | p-OH | p-OH | $Cl^{\ominus}$ |
| I-22 | H | m-OH | m-OH | $Cl^{\ominus}$ |
| I-23 | H | p-Cl | p-Cl | $Cl^{\ominus}$ |
| I-24 | H | m-Cl | m-Cl | $Cl^{\ominus}$ |
| I-25 | p-CN | p-$CH_3$ | p-$CH_3$ | $Cl^{\ominus}$ |
| I-26 | p-SH | p-$OCH_3$ | p-$OCH_3$ | $Cl^{\ominus}$ |
| I-27 | H | p-$OCH_3$ | p-$OCH_3$ | 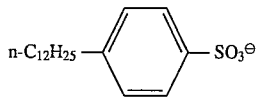 |

The tetrazolium compound of Formula I of the invention may be used alone or in combination of 2 or more kinds thereof. Further, the tetrazolium compound of the invention may be used in combination in a discretionary ratio with other non-invention tetrazolium compounds.

In the invention, specially preferred results can be obtained when the tetrazolium compound of the invention is used together with an anion that combines with the tetrazolium compound of the invention to thereby lower its hydrophilicity. Examples of such the anion include inorganic acid groups such as of perchloric acid; organic acid groups such as of sulfonic acid and carboxylic acid; anionic activators including lower alkylbenzenesulfonate anions such as p-toluenesulfonic acid anion, p-dodecylbenzenesulfonic acid anions, alkylnaphthalenesulfonic, laurylsulfate anions, tetraphenylboron anions, dialkylsulfosuccinate anions such as di-2-ethylhexylsulfosuccinate anions, polyether-alcohol-sulfate aions such as cetylpolyethenoxysulfate anions, stearic acid anions and polyacrylic acid anions.

Any of the above anions may, after being previously mixed with the tetrazolium compound of the invention, be added to the hydrophilic colloid layer, or may be added alone to the silver halide emulsion layer or hydrophilic colloid layer containing or not containing the tetrazolium compound of the invention.

The tetrazolium compound used in the invention can be easily synthesized according to appropriate one of the methods described in Chemical Reviews, vol. 55, pp. 335–483.

The tetrazolium compound in the invention may be used in the amount range of preferably about 1 mg to 10 g, more preferably about 10 mg to 2 g per mol of the silver halide contained in the silver halide photographic light-sensitive material of the invention. In the invention, the tetrazolium compound may be used alone or in arbitrary combination of two or more kinds thereof.

The hydrazine compound used in the invention is preferably a compound represented by the following Formula II:

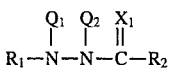

Formula II wherein $R^1$ represents a monovalent organic residue; $R^2$ represents a hydrogen atom or a monovalent organic residue; $Q_1$ and $Q_2$ each represent a hydrogen atom, an alkylsulfonyl group, including one having a substituent, or an arylsulfonyl group, including one having a substituent; $X_1$ is an oxygen atom or a sulfur atom. More preferred among those represented by Formula II are compounds in which $X_1$ is an oxygen atom and $R^2$ is a hydrogen atom.

Examples of the monovalent organic residue represented by $R^1$ or $R^2$ include aromatic residues, heterocyclic residues and aliphatic residues.

Examples of the aromatic residue include a phenyl group, a naphthyl group, and these groups having substituents, such as an alkyl group, an alkoxy group, an acylhydrazino group, a dialkylamino group, an alkoxycarbonyl group, a cyano group, a carboxy group, a nitro group, an alkylthio group, a hydroxy group, a sulfonyl group, a carbamoyl group, a halogen atom, an acylamino group, a sulfonamido group, and thiourea group. Examples of the substituent-having residue include a 4-methylphenyl group, a 4-ethylphenyl group, a 4-oxyethylphenyl group, a 4-dodecylphenyl group, a 4-carboxyphenyl group, a 4-diethylaminophenyl group, a 4-octylaminophenyl group, a 4-benzylaminophenyl group, a 4-acetamido-2-methylphenyl group, a 4-(3-ethylthioureido)phenyl group, a 4-[2-(2,4-di-tert-butylphenoxy)butylamido]phenyl group, and a 4-[2-(2,4-di-tert-butylphenoxy)butylamido]phenyl group.

The heterocyclic residue is a 5- or 6-member single or condensed ring having at least one out of oxygen, nitrogen, sulfur and selenium atoms, which ring may have a substituent. Examples of the heterocyclic residue include those of rings such as a pyrroline ring, a pyridine ring, a quinoline ring, an indol ring, an oxazole ring, a benzooxazole ring, a naphthooxazole ring, an imidazole ring, a benzimidazole ring, a thiazoline ring, a thiazole ring, a benzothiazole ring, a naphthothiazole ring, a selenazole ring, a benzoselenazole ring, and a naphthoselenazole ring.

These heterocyclic groups may have substituents including an alkyl group having 1 to 4 carbon atoms such as methyl or ethyl; an alkoxy group having 1 to 4 carbon atoms such methoxy or ethoxy; an aryl group having 6 to 18 carbon atoms such as phenyl; a halogen atom such as chlorine or bromine; an alkoxycarbonyl group, a cyano group, an amino group, and the like.

Examples of the aliphatic residue include a straight-chain or branched-chain alkyl group, a cycloalkyl group and these groups having substituents, an alkenyl group and an alkynyl group.

The straight-chain or branched-chain alkyl group is, e.g., an alkyl group having preferably 1 to 18 carbon atoms, more preferably 1 to 8 carbon atoms, and examples thereof include a methyl group, an ethyl group, an isobutyl group, a 1-octyl group, and the like.

The cycloalkyl group is, e.g., one having 3 to 10 carbon atoms, and examples thereof include a cyclopropyl group, a cyclohexyl group and an adamantyl group. Substituents to these alkyl and cycloalkyl groups include an alkoxy group such as methoxy, ethoxy, propoxy or butoxy; an alkoxycarbonyl group, a carbamoyl group, a hydroxy group, an alkylthio group, an amido group, an acyloxy group, a cyano group, a sulfonyl group; a halogen atom such as chlorine, bromine, fluorine or iodine; an aryl group such as phenyl, halogen-substituted phenyl or alkyl-substituted phenyl; and the like. Substituted examples of the cycloalkyl group include a 3-methoxypropyl group, an ethoxycarbonylmethyl group, a 4-chlorocyclohexyl group, a benzyl group, a p-methylbenzyl group and a p-chlorobenzyl group. The alkenyl group includes an allyl group. And the alkynyl group includes a propargyl group.

Among the compounds of Formula II, more preferred are those having the following Formula IIa

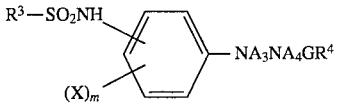

Formula IIa wherein $R^3$ represents an aliphatic group such as octyl or decyl; an aromatic group such as phenyl, 2-hydroxyphenyl or chlorophenyl; or a heterocyclic group such as pyridyl, thienyl or furyl. Any of these groups may have further an appropriate substituent. $R^3$ preferably contains at least one non-diffusible group or silver halide adsorption accelerating group. It is particularly preferably that $R^3$ contain a silver halide adsorption accelerating group.

The non-diffusible group is preferably a ballast group that is usually used for the immobile photographic additive such as a coupler, and examples of the ballast group include relatively photographically inactive groups having 8 or more carbon atoms such as an alkyl group, an alkenyl group, an alkoxy group, a phenyl group, a phenoxy group, and an alkylphenoxy group.

Examples of the silver halide adsorption accelerating group include a thiourea group, a thiourethane group, a mercapto group, a thioether group, a thione group, a heterocyclic group, a thioamido heterocyclic group, a mercapto heterocyclic group, and the adsorption groups described in JP O.P.I. No. 90439/1989.

In Formula IIa, X represents a group substitutable to a phenyl group, and m is an integer of 0 to 4, provided that when m is 2 or more, the two or more Xs may be either the same as or different from each other.

In Formula IIa, $A_3$ and $A_4$ are as defined for $Q_1$ and $Q_2$, respectively, in Formula II, and are each preferably a hydrogen atom.

In Formula IIa, G represents a carbonyl group, a sulfonyl group or a sulfoxy group, but is preferably a carbonyl group.

In Formula IIa, $R^4$ represents a hydrogen atom, an alkyl group, an alkenyl group, an alkynyl group, an allyl group, a heterocyclic group, an alkoxy group, a hydroxyl group, an amino group, a carbamoyl group or an oxycarbonyl group. The most preferred as $R^4$ are a —COOR$^5$ group and a —CON($R^6$)($R^7$) group, wherein $R^5$ represents an alkynyl group or a saturated heterocyclic group; $R^6$ represents a hydrogen atom, an alkyl group, an alkenyl group, an alkynyl group, an aryl group or a heterocyclic group; and $R^7$ is an alkenyl group, an alkynyl group, a saturated heterocyclic group, a hydroxy group or an alkoxy group.

Examples of the hydrazine compound are listed below, but the invention is not restricted by the examples.

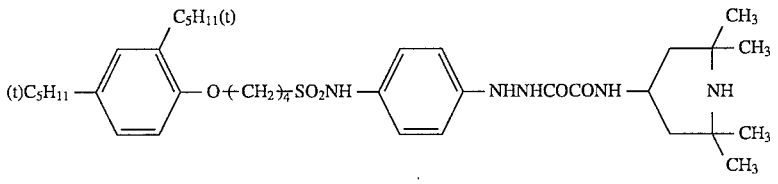

II-1

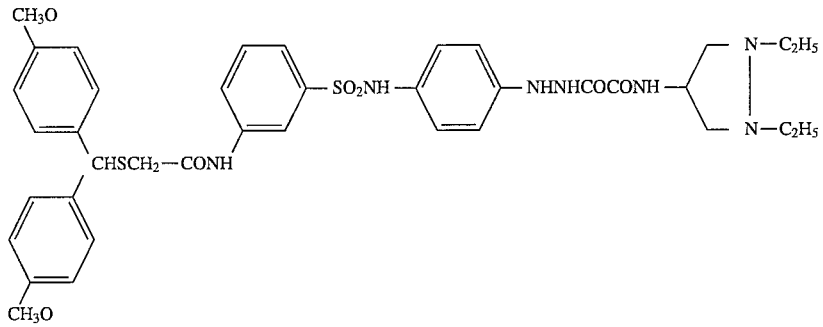

II-2

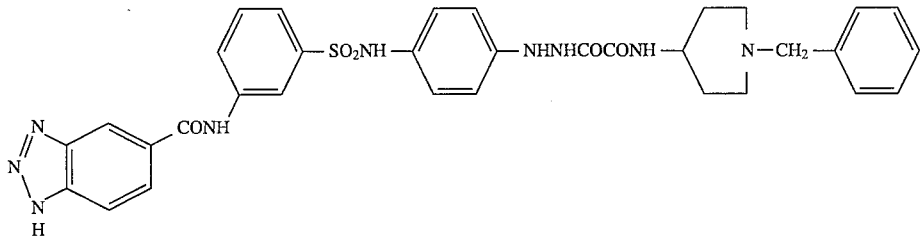

II-3

-continued
II-4
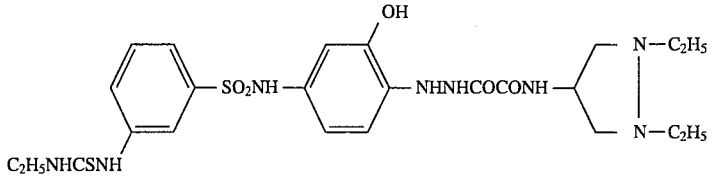
II-5
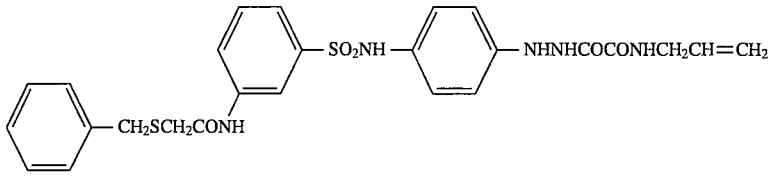
II-6
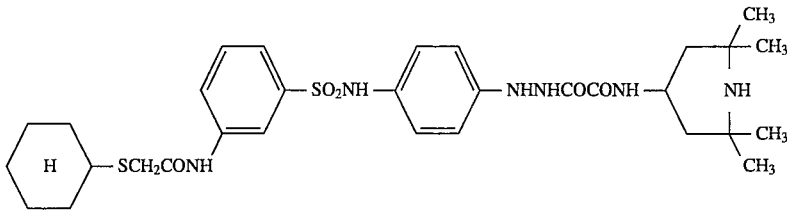
II-7
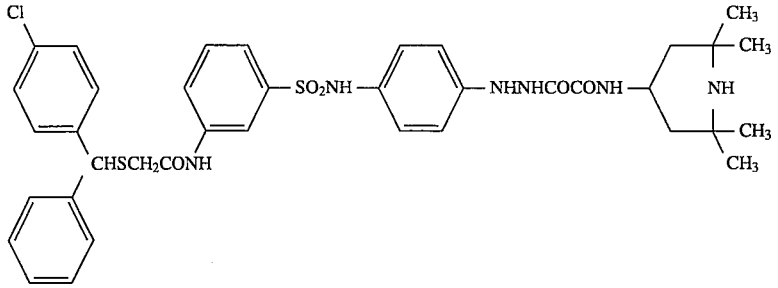
II-8
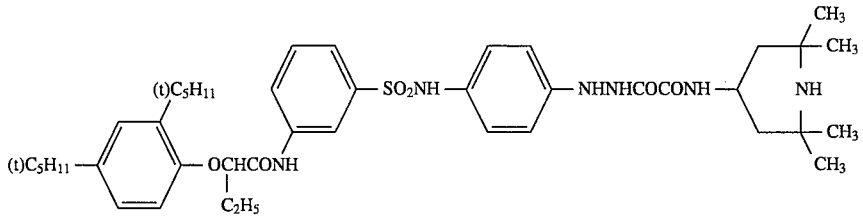
II-9
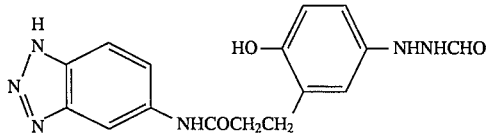
II-10
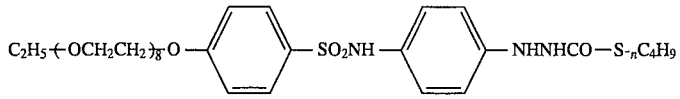
II-11
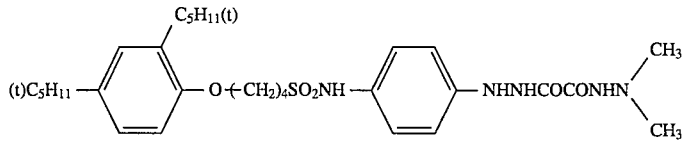
II-12
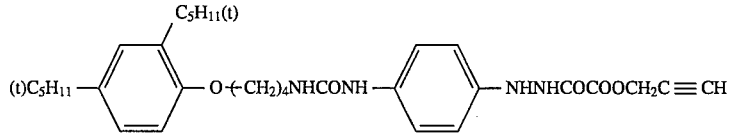

-continued
II-13
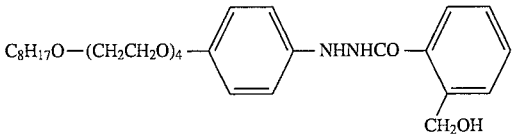
II-14
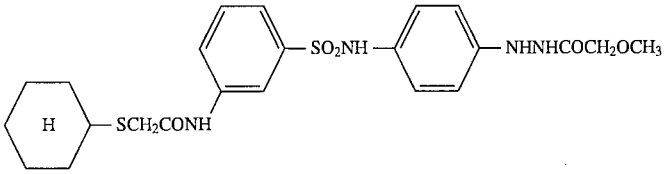
II-15
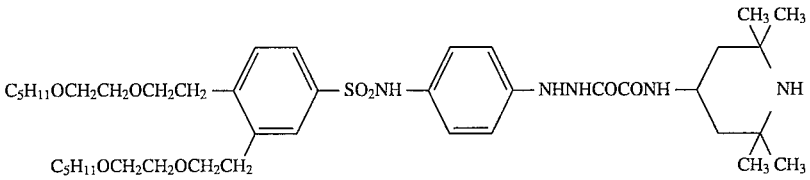
II-16
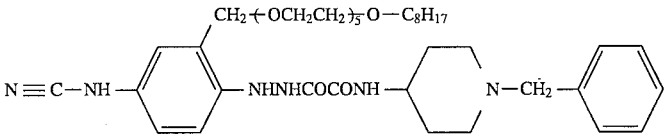
II-17
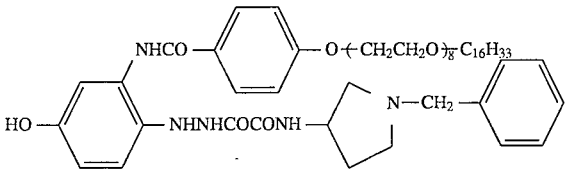
II-18
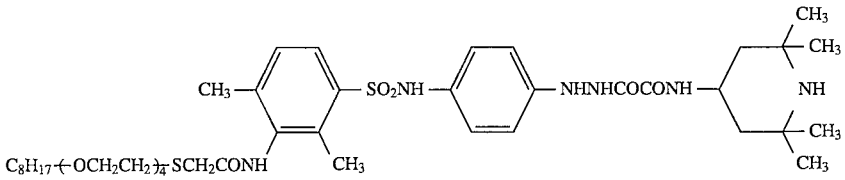
II-19
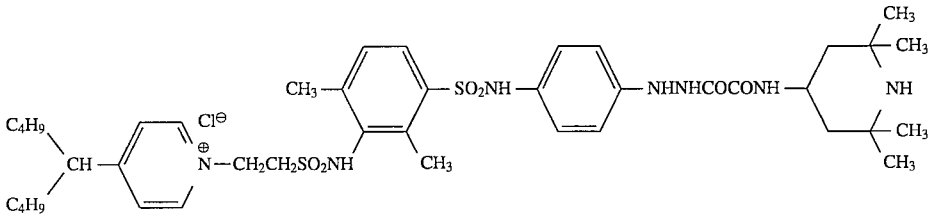
II-20
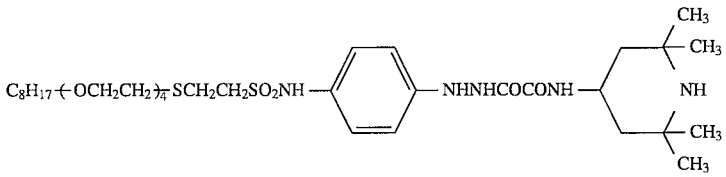
II-21
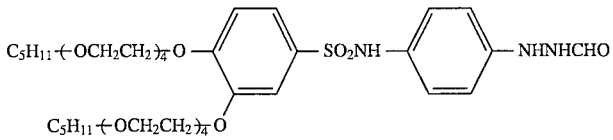

-continued

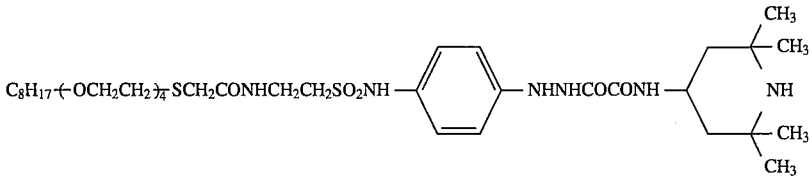

II-22

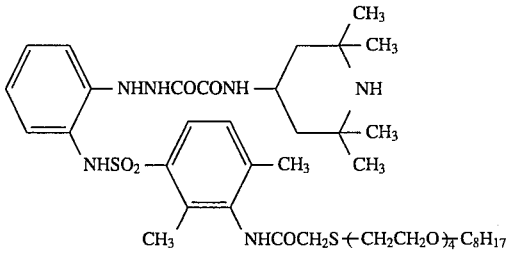

II-23

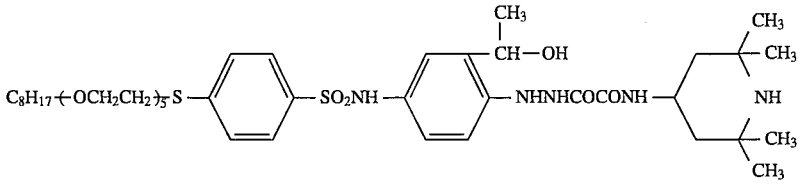

II-24

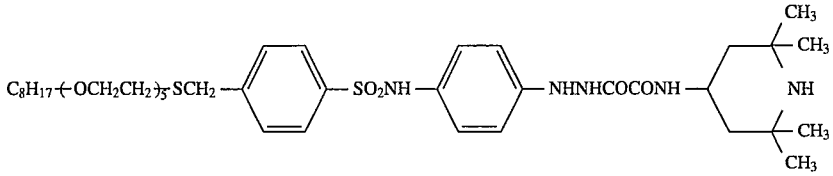

II-25

Other useful examples of the hydrazine compound are compound No. 1 to No. 252 described in Columns 4 through 60 of U.S. Pat. No. 5,229,248.

The hydrazine derivative of the invention can be synthesized according to known methods; for example, according to appropriate one of the methods described in Columns 59 through 80 of U.S. Pat. No. 5,229,248.

The place to which the hydrazine compound is added is the silver halide emulsion layer and/or a non-light-sensitive layer on the silver halide emulsion layer side of the support, and is preferably the silver halide emulsion layer and/or a layer located thereunderneath. The amount of the compound to be added is preferably $10^{-5}$ to $10^{-1}$ mol, more preferably $10^{-4}$ to $10^{-2}$ mol per mol of silver.

In the silver halide photographic light-sensitive material of the invention, where a dye or UV absorbent is to be incorporated into the hydrophilic colloid layer, the dye or UV absorbent may be mordanted by a cationic polymer or the like.

To the above photographic emulsion there may be added various compounds in order to prevent the emulsion from being desensitized or fogged during the manufacture, storage or processing of the silver halide photographic light-sensitive material; said various compounds, known as stabilizers, including azoles, heterocyclic mercapto compounds, mercaptopyridines, heterocyclic mercapto compounds having a water-soluble group such as a carboxyl or sulfo group; stabilizers such as thioketo compounds, azaindenes, benzenethiosulfonic acids, and the like.

Useful examples of the above compounds are described in K. Mees, The Theory of the Photographic Process, 3rd. ed., 1966.

The silver halide photographic light-sensitive material of the invention may contain the following additives: A thickener or plasticizer such as a styrene-sodium maleate copolymer or dextran sulfate; a hardener such as an aldehyde, epoxy, ethyleneimine, active halogen, vinylsulfone, isocyanate, sulfonate, carbodimide, mucochloric acid or acyloyl compound; and a UV absorbent such as 2-(2'-hydroxy-5-tertiary butylphenyl)benzotriazole or 2-(2'-hydroxy-3',5'-di-tertiary butylphenyl)benzotriazole. Further, surfactants usable as a coating aid, emulsifier, permeation-improving agent to processing solutions or defoaming agent or usable for controlling various physical properties of the light-sensitive material include anionic, cationic, nonionic and amphoteric compounds, but the preferred among these are sulfonic group-having anionic surfactants such as a succinate-sulfonated compound, alkylnapththalene-sulfonated compound and alkylbenzene-sulfonated compound.

As the antistatic agent there are the compounds described in JP E.P. Nos. 24159/1971, 39312/1971 and 43809/1973; JP O.P.I. Nos. 89979/1973, 20785/1973, 43130/1973, 90391/1973 and 33627/1972; U.S. Pat. Nos. 2,882,157 and 2,972,535.

In the producing method of the invention, it is preferable that pH of the coating liquid be in the range of 5.3 to 7.5. In the case of a multilayer coating, a mixture of the respective layer-coating liquids mixed in the ratio of their respective coating amounts should preferably be in the above range of 5.3 to 7.5.

In the light-sensitive material of the invention, its component layers may contain a aliding agent such as a higher alcohol ester of a higher fatty acid, casein, a calcium salt of a higher fatty acid, a silicon compound, etc. A liquid paraffin dispersion may also be used for this purpose.

As the brightening agent there may be suitably used a stilbene, triazine, pyrazoline, coumarin or acetylene compound.

These compounds may be water-soluble ones. The may also be ones insoluble in water, which can be used in the dispersion form.

Useful examples of the anionic surfactant are those having an acid group such as a carboxyl, sulfo, sulfate or phosphate group, including alkylcarboxylates, alkylsulfonates, alkylbenzenesulfonates, alkylnaphthalenesulfonates, alkylsulfates, alkylphosphates, N-acyl-alkyltaurines, sulfosuccinates, sulfoalkylpolyoxyethylenealkylphenyl ethers, and polyoxyethylenealkylphosphates.

Useful examples of the amphoteric surfactant include amino acids, aminoalkylsulfonic acid, aminoalkylsulfates, aminoalkylphosphates, alkylbetaines, and amine oxides.

Useful examples of the cationic surfactant include alkylamine salts, aliphatic or aromatic quaternary ammonium salts, heterocyclic quaternary ammonium salts such as ones of pyridium, imidazolium, etc., and aliphatic or heterocyclic phosphonium or sulfonium salts.

Useful examples of the nonionic surfactant include saponin, alkylene oxide derivatives, glycide derivatives, fatty acid esters of polyhydric alcohols, and alkyl esters of sugar.

A technique to improve the dimensional stability of the light-sensitive material by incorporating a polymer latex into the silver halide emulsion layer or backing layer thereof may also be used in the invention.

For the light-sensitive material of the invention, various additives may also be used according to further purposes. For more details of these additives reference can be made to Research Disclosure, vol. 176, Item 17643 (December 1978) and vol. 187, Item 18716 (November 1979). In the publications, the relevant sections to the additives are collectively shown below:

| Additive | RD17643 | M18716 |
|---|---|---|
| 1. Chemical sensitizers | p. 23 | p. 648, right |
| 2. Sensitivity increasing agents | | " |
| 3. Spectral sensitizers Supersensitizers | p. 23–24 | p. 648, right p. 649, right |
| 4. Brightening agents | p. 24 | |
| 5. Antifoggants, stabilizers | p. 24–25 | p. 649, right |
| 6. Light absorbents, filter dyes, UV absorbents | p. 25–26 | p. 649, right to p. 650, left. |
| 7. Antistain agents | p. 25 right | p. 650, left to right |
| 8. Dye image stabilizers | p. 25 | |
| 9. Hardeners | p. 26 | p. 651, left |
| 10. Binders | p. 26 | " |
| 11. Plasticizers, lubricants | p. 27 | p. 650, right |
| 12. Coating aids, surfactants | p. 26–27 | " |
| 13. Antistatic agents | p. 27 | " |

Materials usable as the support of the light-sensitive material of the invention include elastic reflection supports such as paper or synthetic paper laminated with an α-olefinpolymer such as polyethylene, polypropylene, ethylene/butene copolymer, etc.; semisynthetic or synthetic polymer films such as of cellulose acetate, cellulose nitrate, polystyrene, polyvinyl chloride, polyethylene terephthalate, polycarbonate, polyamide, etc.; elastic supports prepared by providing these films with a reflection layer; and metals. Among these support materials the most preferred is polyethylene terephthalate.

The subbing layer applicable to the invention is formed with an organic solvent containing a polyhydroxybenzene, an aqueous latex, vinilidene chloride or polyolefine, which subbing layer is provided on a polyethylene terephthalate film base.

The subbing treatment of the support can be made by chemically or physically treating the surface of the support, said treatment including surface-activation treatments such as chemicals treatment, mechanical treatment, corona-discharge treatment, flame treatment, UV treatment, high-frequency treatment, glow-discharge treatment, active plasma treatment, laser treatment, mixed acid treatment and ozone oxidation treatment.

The subbing layer is distinguished from the component layers according to the invention and is not subjected to any restrictions on coating time and conditions.

In the invention, filter dyes, antihalation dyes and other dyes for various purposes may be used. The dyes used include triallyl dyes, oxanol dyes, hemioxanol dyes, merocyanine dyes, cyanine dyes, styryl dyes and azo dyes. Above all, the oxanol dyes, hemioxanol dyes and merocyanine dyes are useful.

In the light-sensitive material for use in the daylight contact printing process, it is advantageous to use these dyes, which are preferably used so as to make the sensitivity to 400 nm light not more than 1/30 of the sensitivity to 360 nm light.

In practicing the invention, there may be used an organic desensitizer of which the sum of the polarographic anode potential and cathode potential is positive as described in JP O.P.I. No. 26041/1986.

Exposure of the light-sensitive material of the invention can be made by using electromagnetic waves in the spectral region to which the emulsion layer constituting the light-sensitive material is sensitive. As the light source therefor there can be used any known light-sources such as natural light (sunlight), tungsten lamp light, fluorescent lamp light, iodoquartz lamp light, mercury-arc lamp light, micro wave-emitting UV light, xenon arc light, carbon arc light, xenon flash light, cathode ray tube flying spot light, various laser lights, light-emission diode light, and lights released from phosphors excited by electron beam, X-rays, γ-rays and α-rays. Preferred results can be obtained also by attaching an absorption filter that absorbs the wavelength region of 370 nm and downward to a UV light source or by the use of a UV light source comprised mainly of an emitting light wavelength region of 370 to 420 nm.

The exposure time used include an exposure time shorter than 1 microsecond such as, e.g., 100 nanosecond to 1 micro-second as in the case of a cathode ray tube or xenon flash tube, not to speak of the exposure time range of 1 millisecond to 1 second normally used in ordinary camera exposures, and it is of course possible to use an exposure time longer than one second. The exposure may be either continuously or intermittently given to the light-sensitive material.

The invention may be applicable to various light-sensitive materials for graphic arts use, radiographic use, general negative use, general reversal use, general positive use and direct positive use, but the invention can exhibit its significant effect particularly when applied to a light-sensitive material for graphic arts use that requires a high adaptability for a rapid processing.

In the invention, to the processing of the light-sensitive material there may apply conventionally known black-and-white, color and reversal developing methods, but the processing method for giving a high contrast to graphic arts light-sensitive material is most effective.

Examples of the developing agent usable in the invention include dihydroxybenzenes such as hydroquinone, chlorohydroquinone, bromohydroquinone, 2,3-dichlorohydroquinone, methylhydroquinone, isopropylhydroquinone, 2,5-dimethylhydroquinone; 3-pyrazolones such as 1-phenyl-3-pyrazolidone, 1-phenyl-4-meth-yl-3-pyrazolidone, 1-phenyl-4,4-dimethyl-3-pyrazolidone, 1-phenyl-4-ethyl-3-pyrazolidone, 1-phenyl-5-methyl-3-pyrazolidone; aminophenols such as o-aminophenol, p-aminophenol, N-methyl-o-aminophenol, N-methyl-p-aminophenol, 2,4-diaminophenol; pyrogallol, ascorbic acid; 1-aryl-3-pyrazolines such as 1-(p-hydroxyphenyl)-3-aminopyrazoline, 1-(p-methylaminophenyl)-3-aminopyrazoline, 1-(p-aminophenyl)-3-aminopyrazoline, 1-(p-amino-N-methylphenyl)-3-aminopyrazoline. These compounds may be used alone or in combination; particularly, the combined use of an aminophenol and a hydroxybenzene is preferred. The developing agent is used in an amount of normally 0.01 to 1.4 mol/liter.

The preservative used in the invention is a sulfite or metabisulfite such as sodium sulfite, potassium sulfite, ammonium sulfite, sodium metabisulfite. The sulfite is used in an amount of preferably not less than 0.23 mol/liter, and more preferably not less than 0.4 mol/liter.

The developer solution may, if necessary, contain an alkali agent such as sodium hydroxide, potassium hydroxide; an anti-silver-sludge agent such as the related compounds described in JP E.P. No. 4702/1987, JP O.P.I. Nos. 31844/1991, 26838/1992, 362942/1992 and 319031/1989; a pH buffer such as a carbonate, a phosphate, a borate, boric acid, acetic acid, citric acid, an alkanolamine; a dissolution assistant such as a polyethylene glycol, an ester thereof, an alkanolamine; a sensitizer such as a nonionic surfactant containing a polyoxyethylene, a quaternary ammonium compound; a surfactant, a defoaming agent; an antifoggant such as potassium bromide, sodium bromide, nitrobenzindazole, nitrobenzimidazole, benzotriazole, benzothiazole, a tetrazole, a thiazole; a chelating agent such as ethylenediaminetetraacetic acid or an alkali metal salt thereof, a nitrilotriacetate, a polyphosphate; a development accelerator such as the compound described in U.S. Pat. No. 2,304,025 and JP E.P. No. 45541/1972; a hardener such as glutaraldehyde or a hydrogensulfite addition product thereof; a defoaming agent, and the like. The developer solution is used at pH of less than 11.0, and preferably 9.5 to 10.5.

In the invention, as a specific form of development there may be used an activator processing method in which a light-sensitive material containing a developing agent, e.g., in its emulsion layer, is developed in an aqueous alkaline solution. Such a developing method, in combination with a silver halide stabilization process that uses a thiocyanate, is often utilized as one of rapid processing methods of light-sensitive materials. The invention can exhibits its effect even in the case where the light-sensitive material of the invention is subjected to rapid processing by use of such an activator solution.

The developer solution may be in the form of a mixture of solid components, of an organic aqueous solution containing a glycol or an amine, or of a highly viscous pasty liquid; it may be prepared so as to be diluted before use or so as to be used as it is.

In the processing of the invention, the developing may be conducted either at a normal temperature of from 20° to 30° C. or at a higher temperature of from 30° to 40° C.

The fixing solution for use in processing the light-sensitive material of the invention may contain various additives such as an acid, salt, fixing accelerator, wetting agent, surfactant, chelating agent, hardener and the like in addition to a thiosulfate and sulfite. The thiosulfate and sulfite include the potassium, sodium and ammonium salts thereof, the acid includes sulfuric acid, hydrochloric acid, boric acid, formic acid, acetic acid, propionic acid, oxalic acid, tartaric acid, citric acid, malic acid and phthalic acid. The salt includes potassium salts, sodium salts and ammonium salts of these acids. The fixing accelerator includes thiourea derivatives, intramolecular triple bond-having alcohols and thioethers or anion-liberating cyclodextran ethers, crown ethers, diazobicycloundecene and di(hydroxyethyl)butanolamine. The wetting agent includes alkanolamine and alkylene glycol. The chelating agent includes nitrilotriacetic acid and amino acid of EDTA. The hardener includes chrome alum, potassium alum and other aluminum compounds.

The fixing solution in the invention preferably contains an aluminum compound to increase the hardening of the light-sensitive material. The aluminum compound content of the fixing solution is preferably 0.1 to 3 g/liter in terms of aluminum. The sulfite concentration in the fixing solution is preferably 0.03 to 0.4 mol/liter, more preferably. 0.04 to 0.3 mol/liter. The pH range of the fixing solution is preferably 3.9 to 6.5, most preferably 4.2 to 5.3.

In the invention, to meet the demand for shorter processing time, when a film is processed in an automatic processor, the overall processing (dry-to-dry) time required for the leading end of the film to travel the course from its insertion up to its ejection from the drying section is preferably within 45 seconds. The overall processing time herein includes the total time necessary for processing a black-and-white silver halide photographic light-sensitive material, such as all the periods necessary for developing, fixing, bleaching, washing, stabilizing and drying steps in the autoprocessor processing, i.e., dry-to-dry time. If the overall processing time is shorter than 15 seconds, satisfactory photographic performance characteristics can hardly be obtained, accompanyed with desensitization and contrast-deterioration trouble. The overall processing time (dry-to-dry) is more preferably 15 seconds to 45 seconds.

EXAMPLES

The invention is further illustrated by the following examples, but the invention is not limited thereto.

Example 1

An aqueous silver nitrate solution and an aqueous sodium chloride/potassium bromide solution prepared by adding rhodium hexachloride complex in an amount of $8\times10^{-5}$ mol per mol of silver thereto were simultaneously added under a flow rate control to an aqueous gelatin solution, and the thus produced emulsion was desalted, whereby a monodisperse cubic silver chloride emulsion containing 1 mol % silver bromide, having an average grain diameter of 0.13 μm, was obtained.

The obtained emulsion was subjected to sulfur sensitization in the usual manner, and to this were added a stabilizer 6-methyl-4-hydroxy-1,3,3a,7-tetrazaindene and then the following additives to thereby prepare an emulsion coating liquid. After that, an intermediate layer or a first hydrophilic colloid layer coating liquid M-O, an emulsion-protective layer or a second hydrophilic colloid layer coating liquid P-O, a backing layer coating liquid B-O and a backing-protective layer coating liquid BP-O of the following compositions were prepared.

| Preparation of emulsion coating liquid | |
|---|---|
| NaOH (0.5 N) | for adjusting pH to 6.5 |
| Compound (b) | 40 mg/m$^2$ |
| Saponin (20%) | 0.5 ml/m$^2$ |
| Sodium dodecylbenzenesulfonate | 20 mg/m$^2$ |

| | |
|---|---|
| 5-methylbenzotriazole | 10 mg/m$^2$ |
| Compound (f) | 6 mg/m$^2$ |
| Polymer latex (a) | 0.5 g/m$^2$ |
| Hydrophilic styrene-maleic acid copolymer (thickener) | 90 mg/m$^2$ |
| Gelatin | Amount shown in Table 1 |

Compound (a)

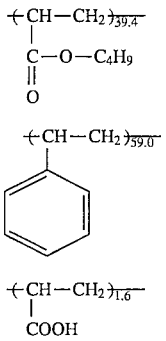

Compound (b)

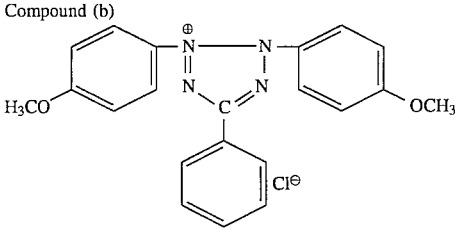

Compound (f)

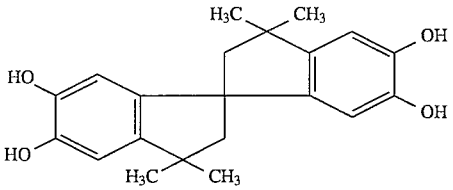

Intermediate layer coating liquid M-O

| | |
|---|---|
| Gelatin | Amount shown in Table 1 |
| Compound (g) | 10 mg/m$^2$ |
| Citric acid | for adjusting pH to 6.0 |
| Synthetic styrene-maleic acid copolymer (thickener) | 45 mg/m$^2$ |

Emulsion protective layer coating liquid P-O

| | |
|---|---|
| Gelatin | Amount shown in Table 1 |
| Compound (g) | 12 mg/m$^2$ |
| Spherical monodisperse silica | Amount shown in Table 1 |
| Compound (h) | 100 mg/m$^2$ |
| Citric acid | for adjusting pH to 6.0 |
| Dye I | 120 mg/m$^2$ |

Backing layer coating liquid B-O

| | |
|---|---|
| Gelatin | 1.5 g/m$^2$ |
| Compound (i) | 100 mg/m$^2$ |
| Compound (j) | 18 mg/m$^2$ |
| Compound (k) | 100 mg/m$^2$ |
| Saponin (20%) | 0.6 ml/m$^2$ |
| Latex (l) | 300 mg/m$^2$ |
| 5-nitroindazole | 20 mg/m$^2$ |
| Hydrophilic styrene-maleic acid copolymer (thickener) | 45 mg/m$^2$ |
| Glyoxal | 4 mg/m$^2$ |
| Compound (m) | 100 mg/m$^2$ |

Backing protective layer coating liquid BP-O

| | |
|---|---|
| Gelatin | 0.8 g/m$^2$ |

| | |
|---|---|
| Compound (g) | 10 mg/m$^2$ |
| Spherical polymethyl methacrylate (4 μm) | 25 mg/m$^2$ |
| Sodium chloride | 70 mg/m$^2$ |
| Glyoxal | 22 mg/m$^2$ |

Compound (g)

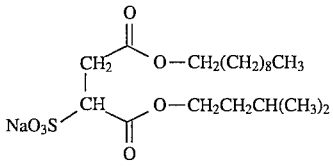

Compound (h)

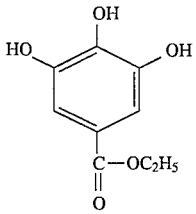

Dye I

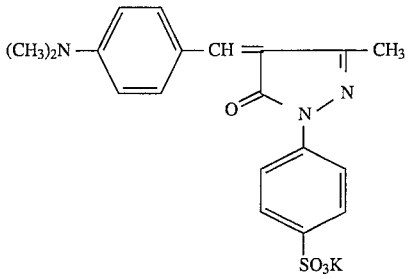

Compound (i)

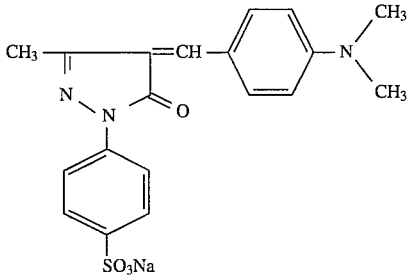

Compound (j)

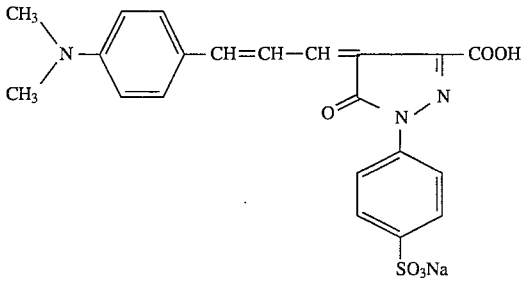

-continued

Compound (k)

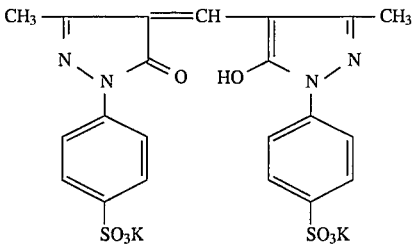

Compound (l)

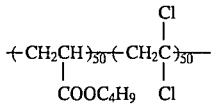

-continued

Compound (m)

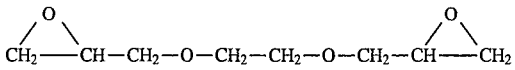

Aside from the above, a polyethylene terephthalate base of 100 μm in thickness subbed as shown in JP O.P.I. No. 19941/1984 was subjected to 10 W/($m^2$.min) corona discharge treatment, and then coated thereon with the following composition by the use of a roll fit coating pan and an air-knife coater. The layer was dried at 90° C. for 50 minutes under parallel air flow drying conditions with overall heat transfer coefficient of 25 kcal ($m^2$.hr.°C.), and further dried for 90 seconds at 140° C. The layer had a dry thickness of 1 μm, and a surface resistivity at 23° C./55% of $1\times10^3\Omega$.

| | |
|---|---|
| Hydrophilic polymer 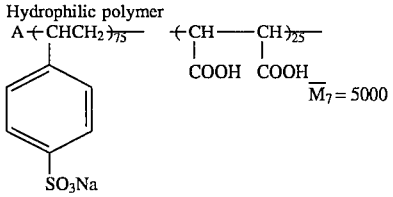 | 70 g/liter |
| Hydrophobic polymer 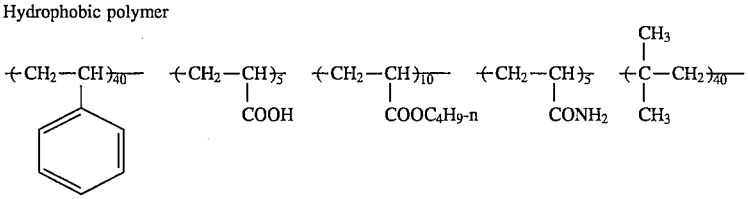 | 40 g/liter |
| Ammonium sulfate | 0.5 g/liter |
| Polyethylene oxide compound (n) (average molecular weight: 600) | 6 g/liter |
| Hardener (o) | 12 g/liter |

Compound (n) A mixture of

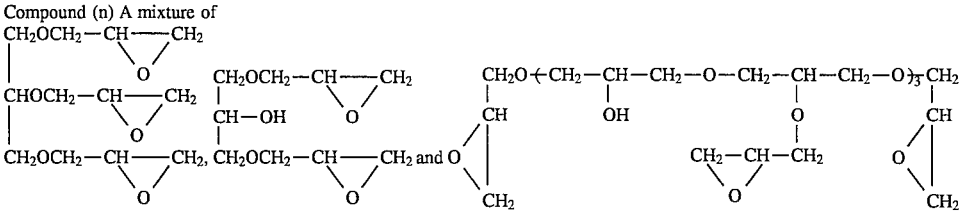

Compound (o)

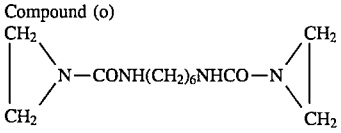

Compound (p)

$(CH_2{=}CH{-}SO_2CH_2)_4C$

On the emulsion-coating side of the thus pretreated base an emulsion layer, an intermediate layer and an emulsion-protective layer in the described order from the support side, while adding thereto 60 mg/m$^2$ of formaldehyde as a hardener with its temperature kept at 35° C., were coated simultaneously by a slide hopper process, and set in a cool-air setting zone (at 5° C.); then on the reverse side of the support a backing layer and a backing-protective layer, while adding thereto 100 mg/m$^2$ of a hardener compound (p), were coated by the slide hopper process, and then set in a cool air (at 5° C.). The respective liquids coated to form the layers, after passing the cool air-setting zone, showed that they had already been sufficiently set. Subsequently, both sides of the coated product were dried simultaneously in the drying zone under the drying conditions described in Table 1. After the backing layer side was coated, the coated product was transported with care not to come in contact with rollers or anything at all up to the take-up section. The above coating speed was 100 meters per minute.

The coating silver weight in the coating was 3.5 g/m$^2$.

Evaluation of samples

Surface roughness:

As for the smooster value, an instrument SM-6B, manufactured by Toei Denshi Kogyo Co., was used to make measurements under the same condition of each sample twice; one at the time after the sample remaining unexposed was processed under the hereinafter described conditions, and the other after the sample was allowed to stand for two hours in an atmospheric condition of 23° C./48% RH.

Printing blurredness test

A 40 cm×40 cm-size 10% screen tint of 175 lines/inch as an original with its layer side facing the light source was placed on a contact printer P-627MF, manufactured by Dai-Nippon Screen Co. A 5 cm×5 cm-size transparent polyethylene terephthalate film of 200 μm in thickness was placed as a spacer in the central part on this original, and further on this was placed a 50 cm×50 cm-size light-sensitive material sample so that its emulsion side touches the original. Both was brought into close contact with each other by vacuumizing for 8 seconds, and the light-sensitive material sample was exposed and then processed under the condition hereinafter described. Where exposure is made under the above conditions, if both the original and the light-sensitive material are in loose contact with each other, the halftone dot image (white dots in a black background) printed on the sample through the spacer blurs to cause the white dots to be defaced. The dot defacement disappears as the degree of contact closeness between the original and the light-sensitive material increases. In this test, to what extent the printed halftone dots become defaced was visually examined for the following five-grade evaluation:

5: No dot defacement at all.

4: Slight dot defacement.

3: Dot defacement causes a spacer image to slightly appear on the print.

2: Dot defacement causes a spacer image to clearly appear on the print

1: The dots forming a spacer image are almost defaced.

Those evaluated as grade 2 and below are on levels unacceptable for practical use.

Pinhole test

A 50% screen tint, partially containing a non-halftone transparent area, was used as an original, and the original and the sample were brought into halftone-image-side-to-emulsion-side contact with each other to be exposed by using a Daylight Printer P-627FM, manufactured by Dai-Nippon Screen Co., with its exposure amount being varied so as to obtain a 53% halftone sample, and then processed under the hereinafter described conditions.

The obtained sample's solid blackened area (non-halftone-dot transpared area turned into black) was measured with a Macbeth densitometer.

The higher the measured value, the smaller the number of pinholes, the better. The samples having a density of 3.5 or lower are unacceptable for practical use because they show conspicuous pinholes.

Drying test

An automatic processor GR-26SR, manufactured by KONICA Corp., installed in a room at a dry-bulb temperature of 30° C. with a relative humidity of 80% was used to continuously develop 5 sheets of 508×610 mm size film in 15 seconds, and a drying temperature necessary for enabling to completely dry all the film sheets was found.

The lower the applicable drying temperature, the better the drying property.

| Developer solution | |
|---|---|
| Composition A: | |
| Pure water (demineralized water) | 150 ml |
| Disodium ethylenediaminetetraacetate | 2 g |
| Diethylene glycol | 50 g |
| Potassium sulfite (55% W/V aqueous solution) | 100 ml |
| Potassium carbonate | 50 g |
| Hydroquinone | 15 g |
| 5-methylbenzotriazole | 200 mg |
| 1-Phenyl-5-mercaptotetrazole | 30 mg |
| Potassium hydroxide | for adjusting pH to 10.4 |
| Potassium bromide | 4.5 g |
| Composition B: | |
| Pure water (demineralized water) | 3 ml |
| Diethylene glycol | 50 mg |
| Disodium ethylenediaminetetraacetate | 25 mg |
| Acetic acid (90% aqueous solution) | 0.3 ml |
| 5-Nitroindazole | 110 mg |
| 1-Phenyl-3-pyrazolidone | 500 mg |

For preparing a developer solution, dissolve the chemicals of Composition A and Composition B in the order given, and add water to make the whole one liter.

| Fixer solution | |
|---|---|
| Composition A: | |
| Ammonium thiosulfate (72.5% W/V aqueous solution) | 230 ml |
| Sodium sulfite | 9.5 g |
| Sodium acetate, trihydrate | 15.9 g |
| Boric acid | 6.7 g |
| Sodium citrate, dihydrate | 2 g |
| Acetic acid (90% W/W aqueous solution) | 8.1 ml |
| Composition B: | |
| Pure water (deminaralized water) | 17 ml |
| Sulfuric acid (50% W/W aqueous solution) | 5.8 g |
| Aluminum sulfate (8.1% W/W aqueous solution calculated in terms of $Al_2O_3$) | 26.5 g |

For preparing a fixer solution, dissolve the chemicals of Composition A and Composition B in the order given, and add water to make the whole one liter. The fixer solution had a pH of about 4.88.

The processing of each sample was made at 35° C. for seconds in an automatic processor GR-26, manufactured by KONICA Corp. The results are shown in Table 1.

TABLE 1

| No. | Amount of gelatin Top layer g/m² | Inter-layer g/m² | EM layer g/m² | Matting agent (top layer) Particle diameter μm | Added amt mg/m² | Gelatin con-sentration Top layer W/W % | Inter-layer W/W % | Drying conditions Item A* °C. | Item B* Sec. | Printing blurred-ness test grade | Surface rough-ness mmHg | Pinhole test density | Drying degree test °C. |
|---|---|---|---|---|---|---|---|---|---|---|---|---|---|
| 1 (Comp.) | 1.0 | 1.0 | 1.0 | 4 | 8 | 3.5 | 3.5 | 21 | 30 | 4.5 | 35 | 5.0 | 55 |
| 2 (Comp.) | 1.0 | 0.5 | 1.0 | 4 | 8 | 3.5 | 3.5 | 21 | 30 | 4.5 | 35 | 3.3 | 48 |
| 3 (Comp.) | 1.0 | 0.5 | 1.0 | 2 | 8 | 3.5 | 3.5 | 21 | 30 | 2 | 21 | 3.7 | 48 |
| 4 (Comp.) | 1.0 | 0.5 | 1.0 | 4 | 8 | 3.0 | 4.0 | 21 | 30 | 4.5 | 35 | 3.6 | 48 |
| 5 (Comp.) | 1.0 | 0.5 | 1.0 | 4 | 8 | 3.5 | 3.5 | 19 | 30 | 4.5 | 35 | 3.5 | 48 |
| 6 (Comp.) | 1.0 | 0.5 | 1.0 | 4 | 8 | 3.5 | 3.5 | 21 | 50 | 4.5 | 35 | 3.6 | 48 |
| 7 (Comp.) | 1.0 | 0.5 | 1.0 | 4 | 3 | 3.5 | 3.5 | 21 | 30 | 2 | 22 | 3.6 | 48 |
| 8 (Inv.) | 1.0 | 0.5 | 1.0 | 4 | 8 | 3.0 | 4.0 | 19 | 50 | 4.5 | 36 | 4.8 | 48 |
| 9 (Inv.) | 0.8 | 0.8 | 0.9 | 4 | 8 | 3.0 | 4.0 | 19 | 50 | 4.5 | 35 | 4.9 | 48 |
| 10 (Inv.) | 0.8 | 0.8 | 0.9 | 8 | 10 | 3.0 | 4.0 | 19 | 50 | 5.0 | 43 | 4.8 | 48 |
| 11 (Inv.) | 0.8 | 0.8 | 0.9 | 4 | 8 | 3.2 | 3.8 | 19 | 50 | 4.5 | 34 | 4.8 | 48 |
| 12 (Inv.) | 0.8 | 0.8 | 0.9 | 4 | 8 | 2.5 | 3.5 | 19 | so | 4.5 | 34 | 4.7 | 48 |

Note:
*Item A: The maximum value of the surface temperature when the $H_2O$/gelatin ratio by weight is 800% to 200%.
*Item B: The drying time required for reducing the $H_2O$/gelatin ratio by weight from 800% top 200%.

As is apparent from Table 1, the samples of the invention have much smaller mat-pin trouble even when the amount of gelatin is reduced, and the vacuumizing time necessary for the contact printing thereof is much shorter than the comparative samples.

Samples were prepared in the same manner as in Example 1 except that the coating of each sample was made using the amount of gelatin shown in Table 1 and the coating silver weight used was 2.8 g/m². The obtained samples were evaluated in the same manner as in Example 1. The results are as shown in Table 2.

TABLE 2

| No. | Amount of gelatin Top layer g/m² | Inter-layer g/m² | EM layer g/m² | Matting agent (top layer) Particle diameter μm | Added amt mg/m² | Gelatin con-sentration Top layer W/W % | Inter-layer W/W % | Drying conditions Item A* °C. | Item B* Sec. | Printing blurred-ness test grade | Surface rough-ness mmHg | Pinhole test density | Drying degree test °C. |
|---|---|---|---|---|---|---|---|---|---|---|---|---|---|
| 21 (Comp.) | 1.0 | 1.0 | 1.0 | 4 | 6 | 3.5 | 3.5 | 21 | 30 | 4.0 | 28 | 4.2 | 55 |
| 22 (Comp.) | 0.5 | 0.5 | 1.0 | 4 | 6 | 3.5 | 3.5 | 21 | 30 | 4.0 | 28 | 3.2 | 42 |
| 23 (Comp.) | 0.5 | 0.5 | 1.0 | 2 | 6 | 3.5 | 3.5 | 21 | 30 | 1.5 | 18 | 3.6 | 42 |
| 24 (Comp.) | 0.5 | 0.5 | 1.0 | 4 | 6 | 3.0 | 4.0 | 21 | 30 | 4.0 | 28 | 3.4 | 42 |
| 25 (Comp.) | 0.5 | 0.5 | 1.0 | 4 | 6 | 3.5 | 3.5 | 19 | 30 | 4.0 | 28 | 3.3 | 42 |
| 26 (Comp.) | 0.5 | 0.5 | 1.0 | 4 | 6 | 3.5 | 3.5 | 21 | 50 | 4.0 | 28 | 3.3 | 42 |
| 27 (Comp.) | 0.5 | 0.5 | 1.0 | 4 | 3 | 3.5 | 3.5 | 21 | 30 | 1.5 | 17 | 3.5 | 42 |
| 28 (Inv.) | 0.5 | 0.5 | 1.0 | 4 | 8 | 3.0 | 4.0 | 19 | 50 | 4.0 | 28 | 4.0 | 42 |
| 29 (Inv.) | 0.5 | 0.7 | 0.8 | 4 | 8 | 3.0 | 4.0 | 19 | 50 | 4.0 | 28 | 4.1 | 42 |
| 30 (Inv.) | 0.5 | 0.7 | 0.8 | 8 | 8 | 3.0 | 4.0 | 19 | 50 | 4.5 | 34 | 4.0 | 42 |
| 31 (Inv.) | 0.5 | 0.7 | 0.8 | 4 | 8 | 3.2 | 3.8 | 19 | 50 | 4.0 | 28 | 4.0 | 42 |
| 32 (Inv.) | 0.5 | 0.7 | 0.8 | 4 | 8 | 2.5 | 3.5 | 19 | 50 | 4.0 | 28 | 4.0 | 42 |

As is apparent from Table 2, the samples of the invention have much smaller pinhole trouble caused by the matting agent even when the amount of gelatin and the coating silver weight are reduced, and the vacuumizing time necessary for the contact printing thereof is much shorter than the comparative samples.

Example 3

Preparation of silver halide emulsion

A double-jet precipitation process was used, and in the course of the process there were added $K_3Os(H_2O)Cl_5$ in an amount of $8\times10^{-5}$ mol per mol of silver and $K_2IrCl_6$ in an amount of $3\times10^{-7}$ mol per mol of silver to the produced emulsion, and after desalting the emulsion in the usual manner, a silver chloride emulsion of monodisperse cubic grains (coefficient of variation: 10%) having an average grain diameter of 0.10 μm was obtained.

To the obtained emulsion were added 4-hydroxy-6-methyl-1,3,3a,7-tetrazaindene, potassium bromide and citric acid, and further added inorganic sulfur in an amount of $3\times10^{-6}$ per mol of silver to effect its chemical ripening up to an extent the maximum sensitivity thereof can be obtained at 60° C. After completion of the chemical ripening, 4-hydroxy-6-methyl-1,3,3a,7-tetrazaindene and 1-phenyl-5-mercaptotetrazaole each in an amount of $3\times10^{-4}$ mol per mol of silver, and gelatin were added to the emulsion.

Preparation of silver halide emulsion D

A double-jet precipitation process was used, and in the course of the process there was added $K_3Os(H_2O)Cl_5$ in an amount of $5\times10^{-5}$ mol per mol of silver to the produced emulsion, and after desalting the emulsion in the usual manner, a silver chlorobromide emulsion (silver chloride: 99 mol %, the rest: silver bromide) of monodisperse (coefficient of variation: 10%) {100} faces-having tabular grains (aspect ratio: 3) (coefficient of variation: 10%) having an average grain diameter of 0.12 μm was obtained.

To the obtained emulsion were added 4-hydroxy-6-methyl-1,3,3a,7-tetrazaindene, potassium bromide and citric acid, and further added inorganic sulfur in an amount of $4\times10^{-6}$ mol per mol of silver to effect its chemical ripening up to an extent the maximum sensitivity thereof can be obtained at 60° C. After completion of the ripening, 4-hydroxy-6-methyl-1,3,3a,7-tetrazaindene and 1-phenyl-5-mercaptotetrazole each in an amount of $3\times10^{-4}$ mol per mol of silver, and gelatin were added to the emulsion.

Preparation of daylight contact-printing silver halide photographic light-sensitive material containing a hydrazine compound The support of Example 1 was used, on the emulsion-coating side of the support a silver halide emulsion of Prescription 11 was coated so as to have a coated silver weight of 1.2 g/m$^2$, then on the coated emulsion layer a silver halide emulsion layer 2 of Prescription 12 was coated so as to have a coated silver weight of 1.2 g/m$^2$, further on this an emulsion-protective layer coating liquid of Prescription 13 was coated, and on this an emulsion-protective layer coating liquid of Prescription 14 was coated and then dried in the same manner as in Example 1. The amounts of gelatin contained in the respective layers in this instance are shown in Table 3. The side opposite to the emulsion-coating side of the support was subjected to the same antistatic subbing treatment as in Example 1, and on this a backing layer and a backing-protective layer were coated and dried in the same manner as in Example 1.

Prescription 11 (silver halide emulsion layer composition)

| | |
|---|---|
| Silver halide emulsion-C | to make Ag coating wt of 1.2 g/m$^2$ |
| Hydrazine compound H-1 | 30 mg/m$^2$ |
| Amino compound Na-1 | 30 mg/m$^2$ |
| Sodium dodecylbenzenesulfonate | 10 mg/m$^2$ |
| 5-Methylbenzotriazole | 10 mg/m$^2$ |
| Compound m | 6 mg/m$^2$ |
| Latex polymer f | 1.0 g/m$^2$ |
| Hardener g | 40 mg/m$^2$ |
| S-1 (sodium iso-amyl-n-decylsulfosuccinate) | 0.7 mg/m$^2$ |
| Thickener (hydrophilic styrene-maleic acid copolymer) | 20 mg/m$^2$ |
| Colloidal silica (average particle diameter: 0.05 μm) | 10 mg/m$^2$ |

Prescription 12 (silver halide emulsion layer 2 composition)

| | |
|---|---|
| Silver halide emulsion D | to make coating Ag wt of 1.2 g/m$^2$ |
| Hydrazine compound H-1 | 25 mg/m$^2$ |
| Amino compound Na-1 | 25 mg/m$^2$ |
| Redox compound RE-1 | 30 mg/m$^2$ |
| S-1 | 1.7 g/m$^2$ |

-continued

Prescription 13 (emulsion-protective interlayer composition)

| | |
|---|---|
| Gelatin | Amount shown in Table 3 |
| Dye AD-3, solid dispersion (average particle diameter: 0.1 μm) | 20 mg/m$^2$ |
| Dye AD-5, solid dispersion (average particle diameter: 0.1 μm) | 80 mg/m$^2$ |
| S-1 | 12 mg/m$^2$ |
| Matting agent, monodisperse silica (average particle diameter: 3.5 μm) | 25 mg/m$^2$ |
| 1,3-vinylsulfonyl-2-propanol | 20 mg/m$^2$ |
| Surfactant h | 1 mg/m$^2$ |
| Colloidal silica (average particle diameter: 0.05 μm) | 20 mg/m$^2$ |
| Hardener g | 30 mg/m$^2$ |

The surface resistivity on the backing layer side after the coating/drying treatment was $1\times10^{11}$ at 23° C./20% RH, while the surface pH value on the emulsion-coated side was 5.4.

The obtained samples each were tested and evaluated in the same manner as in Example 1 except that the developing of each sample was made in the following developer solution 11 under the following conditions. The results are as shown in Table 3.

The backing layer side's surface resistivity after the processing was $5\times10^{11}$ at 23° C./20% RH.

Developer solution 11
Concentrated developer solution Prescription A:

| | |
|---|---|
| Pentasodium diethylaminepentaacetate | 9 g/liter |
| Isoascorbic acid | 0.6 mol/liter |
| Sodium sulfite | 0.45 mol/liter |
| 1-Phenyl-4-methyl-4-hydroxymethyl-3-pyrazolidone | 7 g/liter |
| Potassium carbonate | 2.4 mol/liter |
| 5-Methylbenzotriazole | 0.75 g/liter |
| Potassium bromide | 22 g/liter |
| Boric acid | 6 g/liter |
| Diethylene glycol | 80 g/liter |
| Compound 11 | 0.3 g/liter |
| Potassium hydroxide | for adjusting pH to 10.2 |

For use, 2 parts of water are added to one part of the above concentrated developer A to make a working solution, which is used as a developer replenisher as well as a mother developer solution.

Processing in an automatic processor

An automatic processor SRX-1001, with its drying section provided with a far-infrared heater, manufactured by KONICA Corp., which was improved to enable 25-second processing and had its processing baths filled with the above developer solution 11 and the same fixing solution as was used in Example 1, was used to process the above exposed samples under the following conditions:

Processing conditions

| | | |
|---|---|---|
| Developing | at 35° C. | 8.2 seconds |
| Fixing | at 33° C. | 5 seconds |
| Washing | at normal temperature | 4.5 seconds |
| Squeezing | | 1.6 seconds |
| Drying | at 40° C. | 5.7 seconds |
| Total | | 25 seconds |

-continued
Hydrazine compound H-1
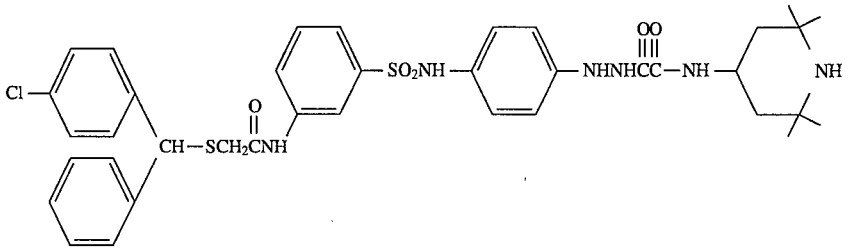
AD-3
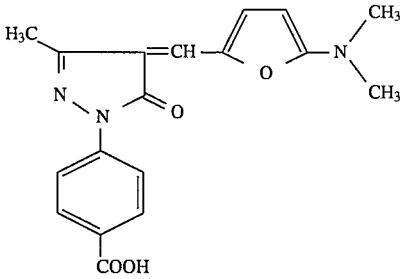
Amino compound Na-1
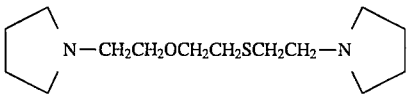
AD-5
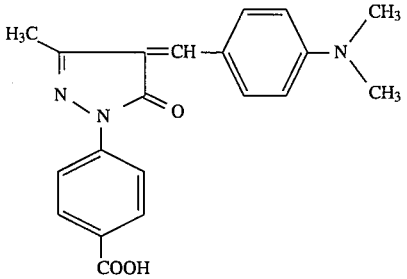
Compound 11
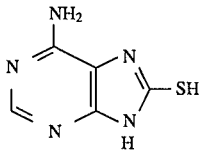
Latex polymer f
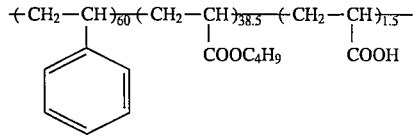
Hardener g
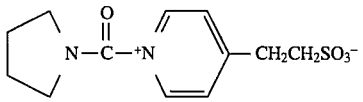

-continued

Surfactant h

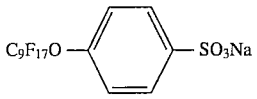

Redox compound RE-1

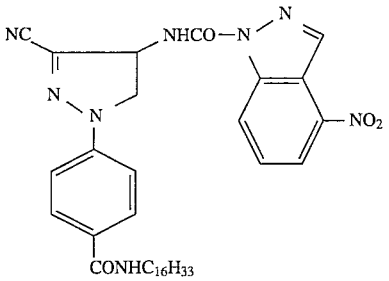

Compound m

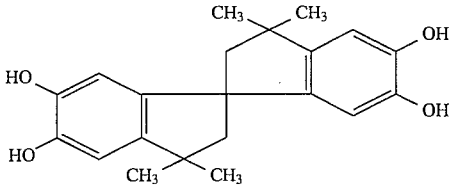

TABLE 3

| No. | Amount of gelatin: Top layer g/m² | Amount of gelatin: Inter-layer g/m² | EM layer 1 g/m² | EM layer 2 g/m² | Matting agent (top layer): Particle diameter μm | Matting agent (top layer): Added amt mg/m² | Gelatin concentration: Top layer W/W % | Gelatin concentration: Inter-layer W/W % | Drying conditions: Item A °C. | Drying conditions: Item B Sec. | Printing blurredness test grade | Surface roughness mmHg | Pinhole test density | Drying degree test °C. |
|---|---|---|---|---|---|---|---|---|---|---|---|---|---|---|
| 1 (Comp.) | 0.7 | 1.0 | 0.5 | 0.5 | 5 | 10 | 3.4 | 3.4 | 21 | 30 | 2 | 24 | 4.0 | 60 |
| 2 (Comp.) | 0.7 | 0.5 | 0.5 | 0.5 | 5 | 10 | 3.4 | 3.4 | 21 | 30 | 2 | 24 | 3.5 | 55 |
| 3 (Comp.) | 0.7 | 0.5 | 0.5 | 0.5 | 2 | 10 | 3.4 | 3.4 | 21 | 30 | 1.5 | 21 | 3.6 | 55 |
| 4 (Comp.) | 0.7 | 0.5 | 0.5 | 0.5 | 5 | 10 | 3.0 | 4.0 | 21 | 30 | 2 | 23 | 3.5 | 55 |
| 5 (Comp.) | 0.7 | 0.5 | 0.5 | 0.5 | 5 | 10 | 3.4 | 3.4 | 16 | 30 | 2 | 30 | 3.4 | 55 |
| 6 (Comp.) | 0.7 | 0.5 | 0.5 | 0.5 | 5 | 10 | 3.4 | 3.4 | 21 | 60 | 2 | 30 | 3.4 | 55 |
| 7 (Comp.) | 0.7 | 0.5 | 0.5 | 0.5 | 5 | 3 | 3.4 | 3.4 | 21 | 30 | 2 | 21 | 3.7 | 55 |
| 8 (Inv.) | 0.7 | 0.5 | 0.5 | 0.5 | 5 | 10 | 3.0 | 4.0 | 16 | 60 | 4.2 | 40 | 5.5 | 48 |
| 9 (Inv.) | 0.4 | 0.5 | 0.5 | 0.5 | 5 | 10 | 3.0 | 4.0 | 16 | 60 | 4.7 | 40 | 5.5 | 45 |
| 10 (Inv.) | 0.4 | 0.5 | 0.5 | 0.5 | 9 | 15 | 3.0 | 4.0 | 16 | 60 | 5.0 | 48 | 5.3 | 45 |
| 11 (Inv.) | 0.4 | 0.5 | 0.5 | 0.5 | 5 | 10 | 3.1 | 3.6 | 16 | 60 | 4.6 | 40 | 5.4 | 45 |
| 12 (Inv.) | 0.4 | 0.5 | 0.5 | 0.5 | 5 | 10 | 2.4 | 3.3 | 12 | 60 | 4.6 | 42 | 5.2 | 45 |

What is claimed is:

1. A method for producing a silver halide photographic light-sensitive material, which comprises a support and photographic layers including a silver halide emulsion layer, a first hydrophilic colloid layer and a second hydrophilic colloid layer provided on said support in this order from said support, said second layer being outermost of said photographic layers, said method comprising forming said photographic layers by coating on one surface of said support;

a silver halide emulsion coating liquid comprising silver halide grains, gelatin, and water to form said silver halide emulsion layer;

a first hydrophilic colloid coating liquid comprising gelatin and water to form said first hydrophilic colloid layer, and a second hydrophilic colloid coating liquid comprising gelatin, particles of matting agent having a size of not less than 4 μm in an amount of 4 mg/m² to 50 mg/m² and water to form said outermost second hydrophilic colloid layer;

the total amount of gelatin contained in said photographic layers being 0.5 g/m² to 2.5 g/m², and the concentration of gelatin in said first hydrophilic colloid coating liquid being larger than that in said second hydrophilic coating liquid by at least 5%, and drying said photographic layers under conditions satisfying the following requirements:

(1) the temperature of the outermost surface of said second hydrophilic colloid layer is maintained between 4° C. and 19° C. while the ratio of water to gelatin in the photographic layers is decreased from 800% to 200%; and (2) the time to be spent for decreasing the ratio of water to gelatin in the photographic layers from 800% to 200% is from 35 seconds to 300 seconds.

2. The method of claim 1, wherein the amount of silver contained in said silver halide emulsion layer is within the range of from 1.0 g/m$^2$ to 3.0 g/m$^2$.

3. The method of claim 1, wherein said photographic layers contain a tetrazolium compound represented by formula I;

(I)

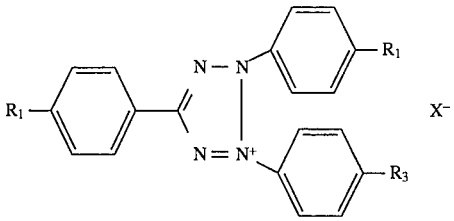

wherein $R_1$, $R_2$ and $R_3$ are each independently an alkyl group, an amino group, an acylamino group, a hydroxyl group, an alkoxyl group, an acyloxy group, a halogen atom, a carbamoyl group, an acylthio group, an alkoxycarbonyl, a carboxyl group, an acyl group, a cyano group, a nitro group a mercapto group, a sulfoxy group or an aminosulfoxy group; and $X^-$ is an anion.

4. The method of claim 1, wherein at least one of said photographic layers contains a hydrazine compound represented by formula II;

(II)

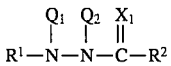

wherein $R^1$ is an aromatic group, a heterocyclic group or an aliphatic group; $R^2$ is a hydrogen atom, an aromatic group, a heterocyclic group or an aliphatic group; $Q_1$ and $Q_2$ are each independently a hydrogen atom, an alkylsulfonyl group or an arylsulfonyl group; and $X_1$ is an oxygen atom or a sulfur atom.

5. The method of claim 1 wherein at least one of said photographic layers contains a hydrazine compound which is a compound represented by formula IIa:

(IIa)

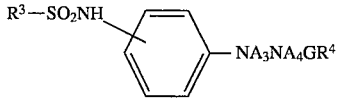

wherein $R^3$ is an aliphatic group, an aromatic group, a heterocyclic group, an alkoxy group, a phenoxy group, an alkylphenoxy group, a thiourea group, a thiourethane group, a mercapto group, a thioether group, a thione group, a thioamido heterocyclic group or a mercapto heterocyclic group; $A_3$ and $A_4$ are each independently a hydrogen atom, an alkylsulfonyl group or an arylsulfonyl group; G is a carbonyl group, a sulfonyl group or a sulfoxy group; and $R^4$ is a hydrogen atom, an alkyl group, an alkenyl group, an alkynyl group, an aryl group, a heterocyclic group, an alkoxyl group, a hydroxyl group, an amino group, a carbamoyl group or an oxycarbonyl group.

6. The method of claim 5, wherein $R^3$ in Formula IIa is an alkyl group, an alkenyl group, an alkynyl group, an alkoxy group a phenyl group, a phenoxy group or an alkylphenoxy group each having 8 or more carbon atoms.

7. The method of claim 5 wherein $R^3$ is a thiourea group, a thiourethane group, a mercapto group, a thioether group, a thione group, a thioamido heterocyclic group, or a mercapto heterocyclic group.

8. The method of claim 1, wherein the outermost surface of said photographic layers has a surface roughness of not less than 25 mmHg after drying.

* * * * *